United States Patent [19]

Brown

[11] 4,347,009

[45] Aug. 31, 1982

[54] OPERATOR INTERCHANGEABLE GEAR DRIVEN PLATEN AND PLATEN DRIVE MECHANISM FOR TYPEWRITERS AND PRINTERS

[75] Inventor: Clifford G. Brown, Lexington, Ky.

[73] Assignee: International Business Machines Corporation, Armonk, N.Y.

[21] Appl. No.: 273,556

[22] Filed: Jun. 16, 1981

[51] Int. Cl.[3] ..... B41J 19/96

[52] U.S. Cl. ..... 400/611; 400/568; 74/384; 74/354

[58] Field of Search ..... 400/568, 611; 74/380, 74/384, 354, 392, 395

[56] References Cited

U.S. PATENT DOCUMENTS

| | | | |
|---|---|---|---|
| 2,919,783 | 1/1960 | Stimson | 400/611 |
| 3,587,811 | 6/1971 | Smith et al. | 400/583 |
| 3,670,981 | 6/1972 | Cavella | 74/354 |
| 3,761,000 | 9/1973 | Hagstrom | 400/583 |
| 4,133,216 | 1/1979 | Gentile et al. | 74/384 |

FOREIGN PATENT DOCUMENTS

| | | | |
|---|---|---|---|
| 2836377 | 2/1980 | Fed. Rep. of Germany | 74/354 |

*Primary Examiner*—William Pieprz
*Attorney, Agent, or Firm*—Laurence R. Letson

[57] ABSTRACT

A support for an idler gear is pivotally mounted about the driving gear axis in a gear driven platen drive for a typewriter. A constraining member mounted with the interchangeable platen engages and constrains the support in a position to insure engagement of the idler with the platen gear and may be sized or shaped to insure proper positioning of the support and idler for a number of different platen gears of varying diameters, allowing platens and platen gears to be readily changed to vary the line feed increment as desired by the operator.

13 Claims, 3 Drawing Figures

OPERATOR INTERCHANGEABLE GEAR DRIVEN PLATEN AND PLATEN DRIVE MECHANISM FOR TYPEWRITERS AND PRINTERS

BACKGROUND OF THE INVENTION

The invention relates to interchangeable gear driven platens in typewriters and printers which automatically compensate for the varying available platen gear diameters, upon insertion of the platen and platen gear into the typewriter or printer.

The rotation of the platen has been accomplished in the past by either a pawl driven ratchet which is rigidly attached to the platen for driving the platen or by a gear driven platen drive. Pawl driven platens have heretofore had the advantage of interchangeability to be capable of changing the amount of line feed while gear driven platens do not provide for ready changability of the gears to easily facilitate the change of the line feed increment. When a gear driven platen is replaced to change the line feed, the gear drive chain must be adjusted to insure proper engagement of all gears and generally requires trained service personnel.

DESCRIPTION OF PRIOR ART

This application is an improvement to the structure disclosed in Ser. No. 211,996, filed Dec. 1, 1980, by Iraj David Shakib and commonly assigned herewith. The above-identified co-pending patent application is the basis upon which this improvement is made.

The co-pending Shakib application discloses a gear driven platen mechanism involving a dual clutching arrangement for disconnecting the drive motor from the drive train and disconnecting the platen and drive train from the motor clutch.

U.S. Pat. No. 3,587,811 illustrates an idler gear spring biased into engagement with a control cam/gear and manually displaceable about the driving gear axis. The spring bias holds the idler gear engaged with the control gear and is capable of doing so by virtue of the relatively light loads encountered during operation.

SUMMARY OF THE INVENTION

A positively displaced idler gear is engageable with a driven platen gear and displaceable about driving gear axis. The positive displacement of the idler gear about the driving gear axis results from engagement of the bifurcated support member having an engaging surface on each of the bifurcations of the member with a constraining member formed with two constraint surfaces positioned predefined distances from the axis of the platen, thereby defining a fixed position for the support member and thus the idler gear. The constraint surfaces are physically defined such that when the carrier member is engaged, by its engagement surfaces, with the contraint surfaces, the idler gear is meshed with the platen gear and thus may transmit the rotary drive of the driving gear to the platen gear.

DRAWINGS

DESCRIPTION OF THE INVENTION

The advantage of operator interchangeable platens in a gear driven line feed arrangement is provided by a typewriter or printer which has a shiftable idler gear engageable with the platen gear. Platen 10 is typically provided with a platen shaft 12 upon which a gear 14 is fixedly mounted. The driven rotation of gear 14 will rotate platen shaft 12 and platen 10.

Figure 2:
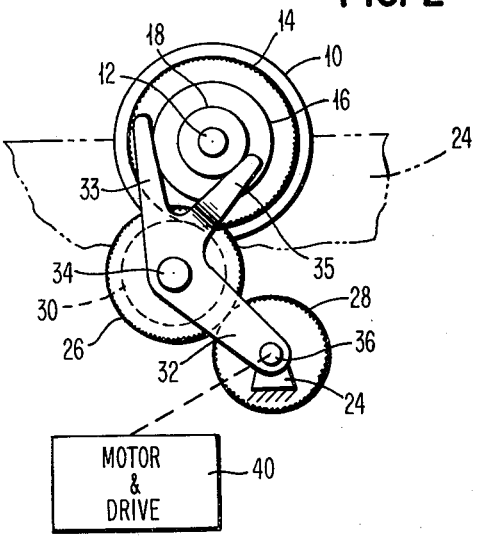
FIG. 2 illustrates an end view of the platen and its drive chain together with the constraining members and the bifurcated carrier member engaged to position the idler gear with a large diameter platen gear.
Figure 3:
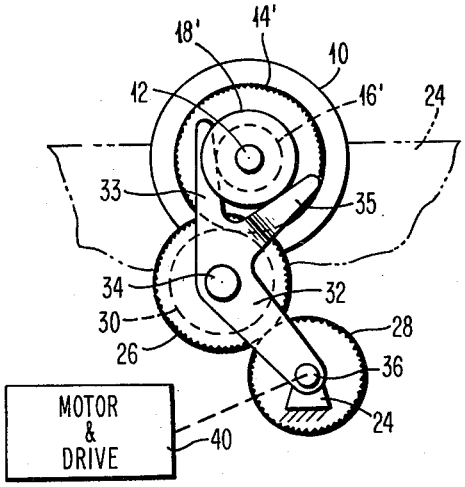
FIG. 3 illustrates the same apparatus as FIG. 2 with the constraining members sized to position to bifurcated carrier member and idler gear for engagement with a smaller diameter platen gear.

Frame 24 is provided with a support not shown of conventional form to support the platen shaft 12 in a fixed spacial relation to the typewriter and, hence, the printing zone. Frame 24 further provides the necessary support for the drive chain comprising gear 28, shaft 36, member 32, idler gear 26, 30. Mounted on platen shaft 12, either fixed to rotate with the platen shaft 12 or such that it is free to rotate with respect to platen shaft 12, is constraint members 16, 18. Constraint members 16, 18 may conveniently be formed in circular form such that the exterior surface of each segment 16, 18 will be equidistant from the center of platen shaft 12. If this be the case, the ability to rotate with respect to shaft 12 is of minimal importance. The radius of the constraint member 16, 18 is the most important aspect of the constraint member 16, 18 and defines the distance from the axis of the platen shaft 12 that bifurcations 33, 35 will occupy and thereby define the spatial position of idler gear 26, 30. Bifurcations 33 and 35 act as engaging surfaces to engage with and interact with constraint members 16, 18, respectively. As can be seen from FIG. 2, the constraint member 16 will be engaged by engaging surace on bifurcation 33 of the bifurcated carrier member 32. Similarly, the engaging surface on bifurcation 35 engages the periphery of constraint member 18. The respective radius of constraint member 18 and the radius of constraint member 16 are determined and sized to define a fixed physical location for the support member 32. By defining the position occupied by support member 32, shaft 34 and hence idler gear 26, 30 will likewise be spacially fixed for a particular set of radius parameters on the constraint members 16, 18. The preferred embodiment is one of circular constraint members or cams of uniform radius about their axis. They may be formed in a single member or may be separately formed and assembled onto the platen shaft 12. Also engageable with platen gear 14 is detent arm 20 which is spring biased by tension spring 22. The detent arm 20 will act to repeatably position gear 14 such that return to a particular line may be accomplished accurately. Referring now to FIG. 3, the radius of constraint members 16' and 18' have been altered to cause the idler gear 30 and 26 to be displaced clockwise about shaft 36 and drive gear 28 to accommodate a platen gear 14' of reduced diameter and hence a reduced number of gear teeth. By reducing the number of gear teeth, the increment of feed for each indexing operation will be larger for a smaller platen gear diameter.

The idler gear 26, 30 is formed as a dual diameter structure to afford drive reduction to the gear 14. Constraint members 16, 18 and 16', 18' may be considered to be cams inasmuch as when they together with platen shaft 12 and platen 10 are inserted into the typewriter or printer, the surfaces of these members 16, 18 and 16', 18' will act to cam the follower into its appropriate position by engaging the engagement surfaces of bifurcations 33 and 35.

Figure 1:
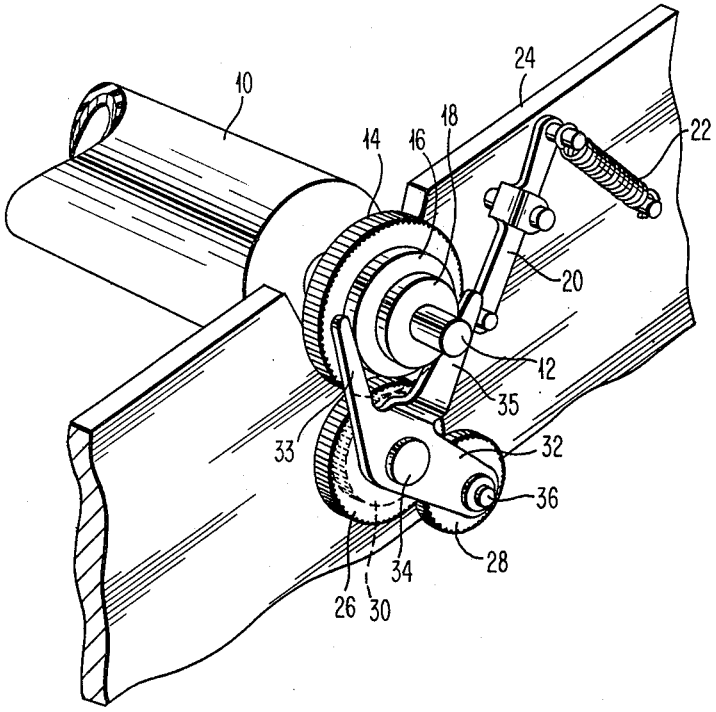
FIG. 1 illustrates the relevant portions of the gear drive chain and idler gear carrier member.

Referring again to FIG. 1, it can be readily seen that bifurcation 35 of carrier member 32 is offset from the plane in which bifurcation 33 exists. This deformation of bifurcation 35 permits the engaging surface to be moved axially with respect to platen shaft 12 thereby insuring the ability to clear the constraint member 16 to engage constraint member 18 when said constraint member 18 is of a smaller diameter than the diameter of constraint member 16.

It should be recognized that, alternatively, constraint members configured to approximate a wedge shape of the appropriate angular formation with the mounting hole formed at a precisely predetermined location for engagement with platen shaft 12 may be substitutable for the concentric cams which form the constraint member 16, 18.

As the platen 10 with its shaft 12, gear 14 and constraint member 16 and 18 are lowered into the supporting portion of frame 24, constraint members 16 and 18 will engage the bifurcations 33, 35 and cause through a camming action the rotation of member 32 about its axis which is coincident with shaft 36. The rotation under the cam control will move idler gear assembly 26, 30 sufficiently to properly mesh the teeth of gear 30 with the platen gear 14. The constraint members 16 and 18 will further act to prevent disengagement of idler gear 30 from gear 14 under heavy loads inasmuch as idler gear 30 may not displace about drive gear 28 so long as constraining members 16 and 18 are positively engaged with the engaging surfaces of bifurcated fingers 33, 35.

Once the shaft 12 is completely seated in the supporting frame 24, the constraining members will then act as a rigid cam to prevent the engagement surfaces on bifurcations 33, 35 from changing position. Motor and drive 40 are illustrated schematically in FIGS. 2 and 3 inasmuch as a detailed description of their operation does not add any to the understanding of the invention.

The above-disclosed arrangement provides the advantages of the operator being able to change the platen to provide a different line feed increment where a gear of predetermined tooth pitch is fixedly mounted to the shaft of the platen. The operator changeability of the platen 10 and platen gear 14 allows an operator greater flexibility in the use of the typewriter or printer without requiring the services of a trained repairman or technician to make adjustments to the position of the idler gear 26, 30.

I claim:

1. A platen drive apparatus for driving interchangeable platens having differing line feed amounts due to different diameter platen gears comprising:

a drive gear;

an idler gear driven by said drive gear;

an interchangeable plate gear having an axis of rotation and a predetermined number of gear teeth, driveable by said idler gear;

means for effecting automatic adjustment of said idler gear in a gear ratio change in which the number of teeth on a platen gear is subject to change with tooth pitch held constant, said means comprising a constraint member and a support member, said constraint member of predetermined configuration supported coaxially with said platen gear axis, said configuration dictated by the number of gear teeth on said platen gear;

said support member for said idler gear pivotally supported about said driving gear and engageable with said constraint member to define a spatially confined position of said idler gear in mesh with said platen gear whereby said constraint member associated with said platen gear causes constrained engagement of said idler with said platen gear, thereby facilitating operator exchange of platens, platen gears and constraint members to control the amount of line feed of said gear driven platen.

2. The platen drive apparatus of claim 1 wherein said support member is formed with a bifurcated end defining engagement surfaces for engaging said constraint member.

3. The platen drive apparatus of claim 2 wherein said constraining member comprises a pair of circular camming members mounted coaxially with said platen gear.

4. The apparatus of claim 2 wherein each of said engagement surfaces of said bifurcated end engage said constraining member.

5. The apparatus of claim 4 wherein said bifurcated end is formed with the bifurcations offset to present said engagement surfaces in different planes.

6. The apparatus of claim 3 wherein said camming members radii are predetermined to position said support to engage said idler gear with the particular platen gear associated with said camming members.

7. The platen drive of claims 1, 2, 3 or 6 wherein said idler gear comprises a pair of interconnected coaxial gears for drive reduction.

8. A gear driven platen drive for a typewriter comprising:

a drive means including a drive gear having an axis;

a platen gear;

a platen;

means attaching said platen gear to said platen;

an idler gear means engaged with said drive gear;

a support for said idler gear means pivotally supported about said axis of said drive gear, said idler gear means rotationally supported on said support, said support pivotally moveable to engage said idler gear means in meshing relation with said platen gear;

a constraining member in fixed spatial relation to said platen when said platen is installed in said typewriter;

said support further comprising engaging surfaces for engaging said constraining member upon placement of said platen in said typewriter to constrain said support in a fixed predefined position effecting engagement of said idler gear with said platen gear.

9. The platen drive of claim 8 wherein said constraining member comprises a pair of circular camming members mounted on said means attaching said platen gear to said platen, said camming members each being engageable by said support.

10. The platen drive of claim 8 or 9 wherein said means attaching said platen gear to said platen comprises a shaft coaxial with said platen.

11. The platen drive of claim 9 wherein said camming members radii are predetermined to position said support to engage said idler gear with the particular platen gear associated with said camming means.

12. The platen drive of claims 8, 9 or 11 wherein said idler gear means comprises a pair of coaxial gears for drive reduction.

13. The platen drive of claim 8 wherein said constraining member comprises constraint surfaces which are predefined distances from said platen and engageable by said support to define a fixed position for said idler gear means relative to said platen gear.

* * * * *